US007143904B2

(12) United States Patent
Zhang et al.

(10) Patent No.: US 7,143,904 B2
(45) Date of Patent: Dec. 5, 2006

(54) CONTAINER AND HANDLE ASSEMBLY

(75) Inventors: Qiuchen Peter Zhang, Burlington Township, NJ (US); Christopher L. Gabala, Maumee, OH (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 11/011,943

(22) Filed: Dec. 15, 2004

(65) Prior Publication Data

US 2006/0124580 A1 Jun. 15, 2006

(51) Int. Cl.
*B65D 23/10* (2006.01)
*B65D 1/02* (2006.01)
*B65D 23/00* (2006.01)

(52) U.S. Cl. ..... 215/396; 215/40; 220/769; 220/770; 394/33

(58) Field of Classification Search ..... 215/396, 215/398, 40, 42–44, 386; 220/769–771; 294/33, 27.1, 31.2
See application file for complete search history.

(56) References Cited

U.S. PATENT DOCUMENTS

| | | | | |
|---|---|---|---|---|
| 2,406,696 | A | 8/1946 | Leslie | |
| 2,610,081 | A | 9/1952 | Bushman | |
| 3,202,309 | A | 8/1965 | Simpson | |
| 3,261,635 | A | 7/1966 | Talay | |
| 3,717,288 | A | 2/1973 | Schlegal | |
| RE29,708 | E | 7/1978 | Schlegel | |
| 4,273,246 | A | 6/1981 | Thompson | |
| 4,368,826 | A | 1/1983 | Thompson | |
| 4,379,578 | A | 4/1983 | Schuler | |
| 4,456,135 | A | 6/1984 | Beekes | |
| 4,552,396 | A | 11/1985 | Rais | |
| 4,660,876 | A | 4/1987 | Weldin et al. | |
| 4,667,359 | A | 5/1987 | Polotti | |
| 4,821,372 | A | 4/1989 | Casiello | |
| 4,842,158 | A | 6/1989 | Reyes, Jr. | |
| 4,896,913 | A | 1/1990 | Kennedy | |
| 4,936,614 | A | 6/1990 | Russell | |
| 4,982,868 | A | 1/1991 | Robbins, III | |
| 4,982,869 | A | 1/1991 | Robbins, III | |
| 5,183,169 | A | 2/1993 | Grzych | |
| 5,297,686 | A | 3/1994 | Takeuchi | |
| 5,535,901 | A * | 7/1996 | Ishii et al. | 215/396 |
| 5,897,150 | A | 4/1999 | Rubini | |
| 6,279,794 | B1 * | 8/2001 | Miyazaki | 224/148.7 |
| 6,352,235 | B1 | 3/2002 | Cizek | |
| 6,543,825 | B1 | 4/2003 | Dragutin | |

FOREIGN PATENT DOCUMENTS

| | | | |
|---|---|---|---|
| FR | 2590867 | A1 * | 6/1987 |
| JP | 717544 | A * | 1/1995 |

* cited by examiner

*Primary Examiner*—Sue A. Weaver
(74) *Attorney, Agent, or Firm*—Venable LLP; Keith G. Haddaway; Stuart I. Smith

(57) ABSTRACT

A container and handle assembly includes a container having a body and an integral neck finish with a pocket and a ledge diametrically spaced from the pocket. A handle has a C-shaped yoke with a first arm having an end hook for receipt in the pocket, and a second arm having an end lug for engaging the ledge on the container body.

14 Claims, 3 Drawing Sheets

CONTAINER AND HANDLE ASSEMBLY

FIELD OF THE INVENTION

This invention relates generally to containers, and more particularly to containers having a handle.

BACKGROUND OF THE INVENTION

Containers for flowable products, such as liquids and granular products, have been formed of plastic by a variety of methods. For example, plastic containers have been blow molded to provide a container body with an integral neck finish and handle. Plastic containers have been formed with a container body including a neck finish integral with the container body and a handle separately attached to the container. Other containers have been formed by positioning an injection molded handle and finish in a blow mold so that the handle and finish are incorporated onto the container as it is blow molded.

In at least some instances, it may be desirable to form the container body separately from the handle so that the molds used to form the container body can be more simple in design in that they do not require pockets to form or hold the handle. It may also be desirable to use a different plastic material for strength, color, esthetics or cost issues, for example, when the handle need not be made of the same material as the container body.

SUMMARY OF THE INVENTION

A container and handle assembly includes a container having a body and an integral neck finish with a pocket and a ledge diametrically spaced from the pocket. A handle has a C-shaped yoke with a first arm having an end hook for receipt in the pocket, and a second arm having an end lug for engaging the ledge on the container neck finish.

The container and handle assembly provides a mechanism for securely and rigidly attaching the handle to the container. In use, the container and handle assembly is durable, light weight, and easy to grasp. In manufacture, the container molding process is efficient and economical. The container assembly may be constructed so that the handle is attached to the container at one or both of the ends of the handle.

BRIEF DESCRIPTION OF THE DRAWINGS

These and other objects, features, advantages and aspects of the present invention will be apparent from the following detailed description of the preferred embodiments and best mode, the appended claims and the accompanying drawings in which:

DETAILED DESCRIPTION OF THE PREFERRED EMBODIMENTS

Figure 1:
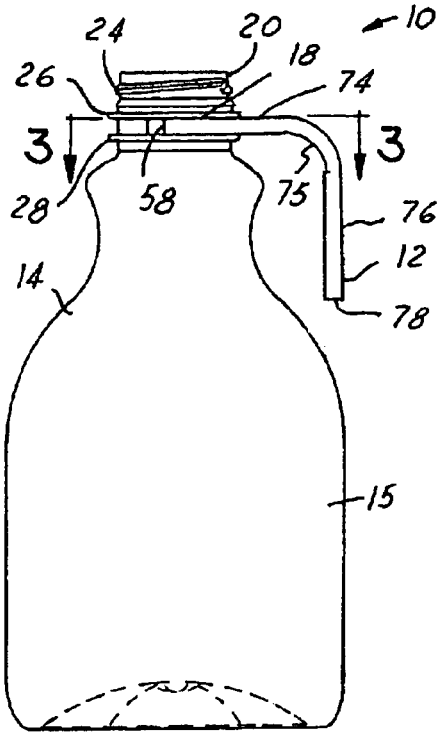
FIG. 1 is an elevational view showing a container and handle assembly constructed according to one embodiment of the invention.
Figure 2:
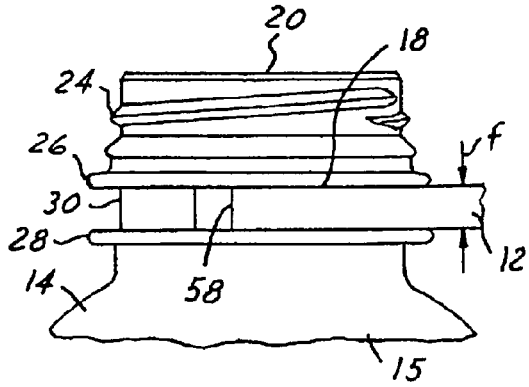
FIG. 2 is an enlarged fragmentary view of the container and handle assembly of FIG. 1.
Figure 3:
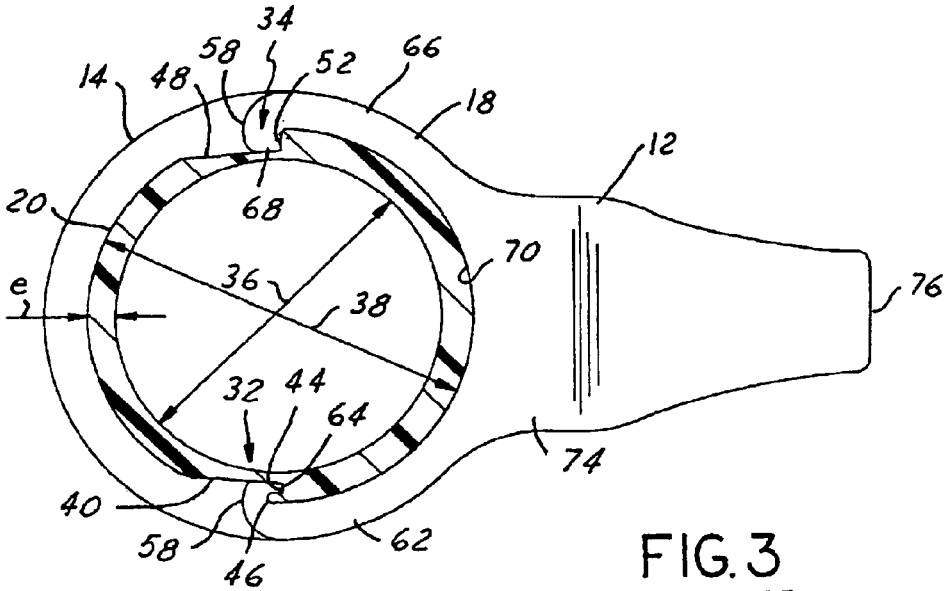
FIG. 3 is a partially cross-sectioned view taken generally along the line 3—3 of FIG. 1.
Figure 7:
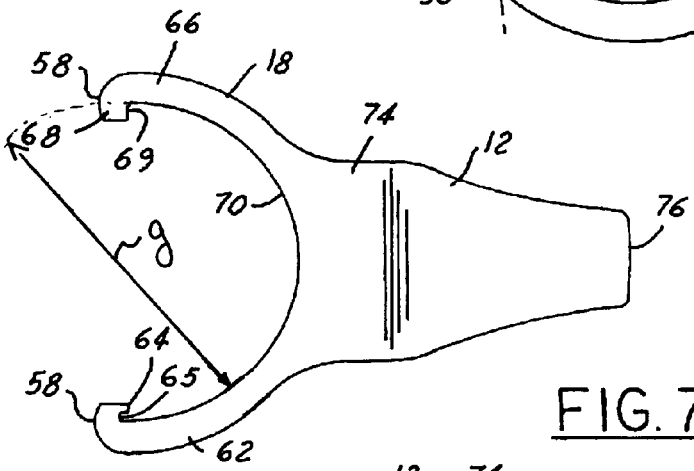
FIG. 7 is a top view of the handle of FIG. 6.

Referring in more detail to the drawings, FIG. 1 illustrates a container and handle assembly 10 constructed according to one embodiment of the invention. The assembly 10 has a handle 12 with opposite ends 58, constructed according to one presently preferred embodiment of the invention, attached to the neck finish 20 of a container 14 with a body 15. The container 14 is preferably blow molded, with the handle 12 attached to the container 14 in a secondary operation. As best shown in FIGS. 2, 3 and 7, to facilitate attachment of the handle 12 to the container 14, the handle 12 has a generally C-shaped yoke 18 sized for a snap fit over a portion of a neck finish 20 on the container 14.

Figure 5:
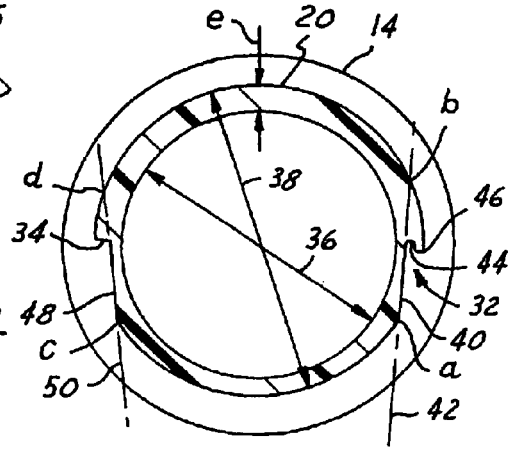
FIG. 5 is a sectional view taken generally along line 5—5 in FIG. 4.

As shown in FIG. 2, the neck finish 20 includes external threads or thread segments 24 to receive and secure a closure on the container 14, an upper flange 26 adjacent the threads 24 and a lower flange 28 spaced axially a predetermined distance from the upper flange 26 to define an annular channel 30 between the flanges 26, 28. As shown in FIGS. 3 and 5, the neck finish 20 has a chordal pocket 32 and a radially outwardly extending ledge 34 diametrically spaced from the pocket 32. In the area of the channel 30, the neck finish 20 has inner and outer diameters 36, 38, respectively, that define a thickness (e) between them. Desirably, the chordal pocket 32 has a first surface 40 extending along a chordal line 42 (FIG. 5) defined between points (a, b). The first surface 40 is shown here as extending approximately halfway along the chordal line 42, though it should be recognized that the first surface 40 could extend along less or more than the length of the chordal line 42 than as shown here. The first surface 40 transitions to a recessed pocket surface 44 between the inner and outer diameters 36, 38. The pocket surface 44 defines at least in part a lip 46 spaced radially outwardly from the first surface 40.

Figure 4:
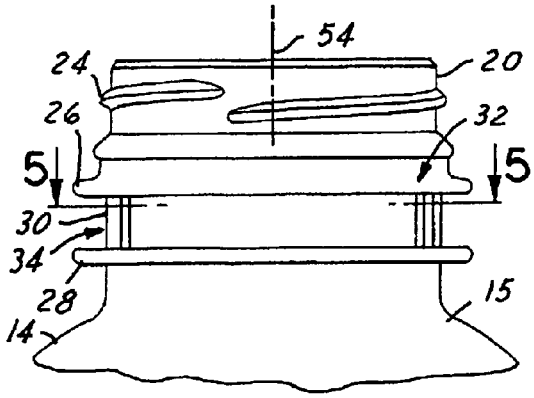
FIG. 4 is an enlarged fragmentary view of a neck finish of the container of FIG. 1.

The ledge 34 constructed generally diametrically opposite the chordal pocket 32 is defined by a recess 48 in the finish 20 having a radially inner surface 48. In the presently preferred embodiment, the surface 48 extends along a chordal line 50 between the inner and outer diameters 36, 38 defined between points (c,d). The first surface 48 extends partially along the chordal line 50 and terminates at the ledge 34. Desirably, the ledge 34 is generally diametrically opposite the pocket surface 44 of the chordal pocket 32. As shown in FIG. 4, the chordal pocket 32 and the ledge 34 extend generally parallel to a longitudinal axis 54 of the container 14 between the upper and lower flanges 26, 28.

Figure 6:
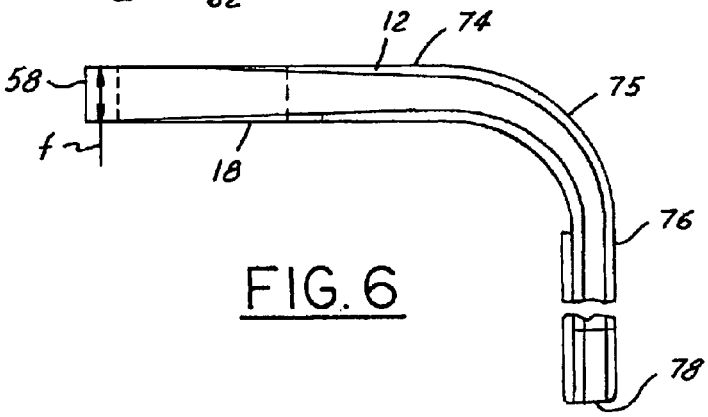
FIG. 6 is a fragmentary side view of a handle from the container and handle assembly of FIG. 1.

As shown in FIGS. 1 and 6, the handle 12 has the yoke 18 at one end, a radially outwardly oriented section 74 extending from the yoke 18 and leading to a bent section 75, that in turn leads to an axially oriented section 76 that terminates at a free end 78. Although in this embodiment, the end 78 preferably remains spaced and unattached from the body of the container 14, the yoke 18 provides a sufficiently strong, rigid and durable attachment to the finish 20 of the container 14 in use. Desirably, to facilitate handling of the container, the bent handle can be grasped from either the top or side of the container.

To facilitate attachment of the handle 12 to the container 14, the yoke 18 as best shown in FIGS. 3 and 7, has a first arm 62 with an end hook 64 configured for receipt in the pocket 32 with the lip 46 received in a recess 65 defined by the hook 64. The end hook 64 preferably extends back toward the radially and axially extending sections 74, 76 of the handle 12. Further, the yoke 18 has a second arm 66 with a finger or end lug 68 that has a radially inwardly extending surface 69 preferably arranged for a snap fit over the ledge 34 on the finish 20. The first and second arms 62, 66 define at least in part an inner generally C-shaped surface 70 having an inner diameter (g) that is slightly greater than the outer diameter 38 of the finish 20 in the area of the channel. Further, to increase the stability of the connection of the yoke 18 to the finish 20, the first and second arms 62, 66 preferably have a thickness (f) that is generally equal to or just slightly less than the distance between the upper and lower flanges 26, 28 so that the arms are closely received between the flanges 26, 28. In assembly, the end hook 64 of the yoke 18 is inserted into the pocket 32 in the finish 20, and thereafter, the end lug 68 is rotated generally about the longitudinal axis 54 of the container 14 toward the ledge 34 until it snaps into locking engagement with the ledge 34 and disposes the yoke surface 70 against the neck finish 20 in the channel 30.

Figure 10:
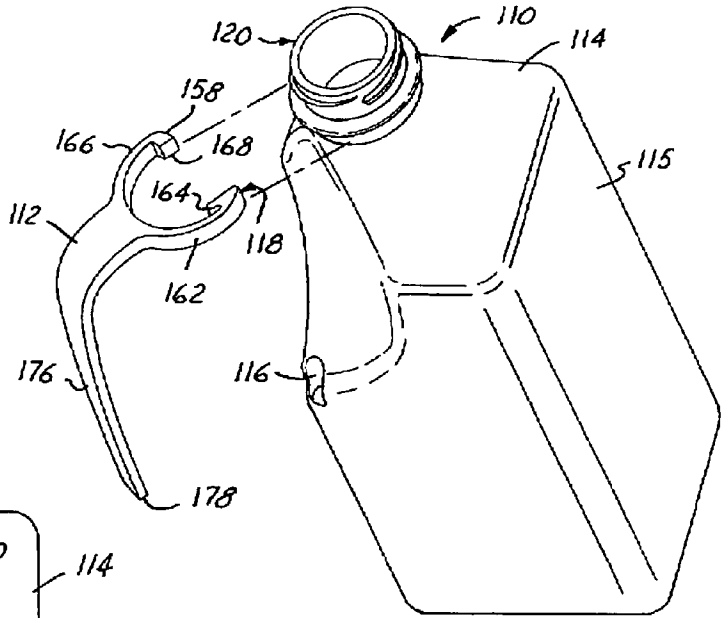
FIG. 10 is a perspective view of the container and handle of FIG. 9.
Figure 9:
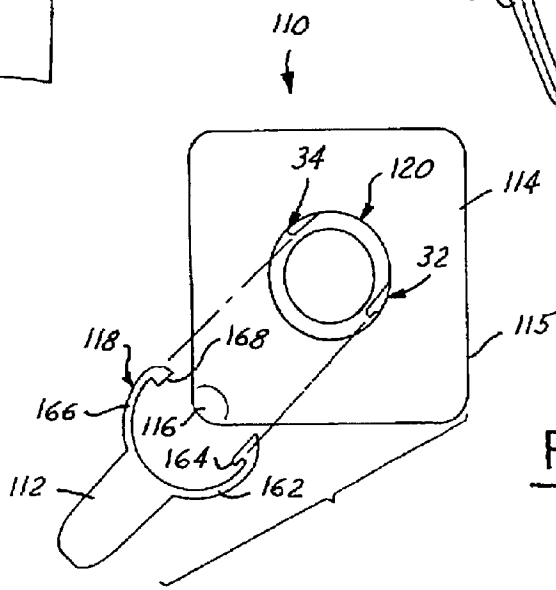
FIG. 9 is an exploded top view showing the container and handle from the assembly of FIG. 8 disassembled from one another.
Figure 8:
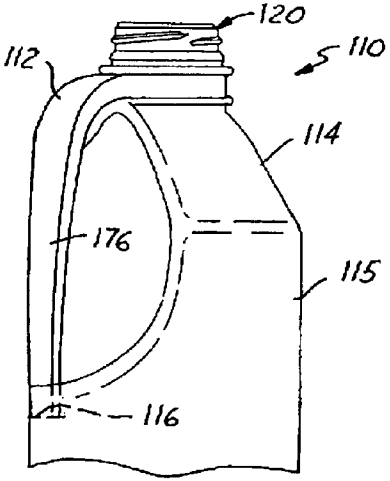
FIG. 8 shows a partial side view of a container and handle assembly constructed according to another embodiment of the invention.

In FIGS. 8–10, an alternate embodiment of a container and handle assembly is shown at 110. For simplicity of discussion, the same reference numerals are used to describe like features as in the first embodiment assembly 10.

The container and handle assembly 110 includes a container 114 with a body 115 having an axially opening blind recess 116 aligned between a pocket 32 and a ledge 34 formed in a neck finish 120 of the body 115. The container 114 and neck finish 120 may otherwise be constructed in the same manner as the container 14 and neck finish 20 discussed, and thus are not discussed further.

The container and handle assembly 110 has a handle 112 with opposite ends 158, 178, wherein the end 158 is defined by a yoke 118 preferably having the same construction as yoke 18 in the assembly 10 previously discussed, with a hook 164 on one arm 162 and an end lug 168 on the other arm 166. The handle 112 has a leg 176 centrally and generally axially extending from the yoke 118 to the end 178 that in assembly is received in the recess 116 in the body 115. To assemble the handle 112 onto the container 114, the end 178 is preferably inserted into the recess 116 and then the hook 164 and lug 168 are engaged with the pocket 32 and ledge 34 as previously set forth. Accordingly, the handle 112 is attached to the container 114 at two locations, namely, at the neck finish 120 by way of the yoke 118 and at the recess 116 by way of the leg 172 at end 178. Otherwise, the assembly of the handle 112 to the container 114 remains substantially the same as discussed above, and thus is not discussed further.

It should be recognized that upon reading the disclosure herein, one ordinarily skilled in the art would readily recognize other embodiments than those disclosed herein, with those embodiments being within the scope of the claims that follow. For example, it should be recognized that the first surface of the chordal pocket and the surface of the ledge could extend along a path other than that being defined by a chord of the neck finish, and that they could extend generally circumferentially, at least in part, or otherwise. Also, by way of example without limitation, the ledge 34 and end lug 78 may be inclined relative to a radius of the neck finish, such as to define an undercut recess that defines the ledge. Accordingly, this disclosure herein is intended to be exemplary, and not limiting. The scope of the invention is defined by the claims that follow.

What is claimed is:

1. A container and handle assembly, comprising:

a container having a body and an integral neck finish, said neck finish having a pocket and a ledge diametrically spaced from said pocket, and a handle that includes a C-shaped yoke having a first arm with an end hook for receipt in said pocket and a second arm with an end lug for engaging said ledge;

wherein said ledge is not the same shape as said pocket, and wherein said end hook is not the same shape as said end lug.

2. The assembly of claim 1 wherein said body has a recess between said pocket and said ledge and said handle has a leg extending from said yoke for receipt in said recess on said body.

3. The assembly of claim 1 wherein said handle has opposite ends, one of said ends being defined by said yoke, the other of said ends being a free end spaced from said body.

4. The assembly of claim 1 wherein in the area of said pocket and said ledge, said neck finish has an outer diameter and said yoke has an inner diameter, said inner diameter being greater than said outer diameter.

5. The assembly of claim 1 wherein said neck finish has axially spaced upper and lower flanges with said pocket and said ledge extending between said upper and lower flanges.

6. The assembly of claim 5 wherein said upper and lower flanges are axially spaced from one another one distance, and said first and second arms have a thickness that is less than said one distance.

7. The assembly of claim 6 wherein said upper and lower flanges extend circumferentially about said neck finish.

8. The assembly of claim 1 wherein said handle has a leg extending from said yoke and said end hook extends generally toward said leg.

9. The assembly of claim 1 wherein said neck finish has an outer diameter and said pocket has a surface extending along a chordal line defined between a pair of points on said outer diameter.

10. The assembly of claim 9 wherein said neck finish has an inner diameter and said surface transitions into a recessed pocket surface between said inner and outer diameters.

11. The assembly of claim 10 wherein said recessed pocket surface defines at least in part a lip spaced radially outwardly from said surface.

12. A container and handle assembly, comprising:

a container having a body and an integral neck finish, said neck finish having an outer diameter and an inner diameter, with a pocket extending generally laterally between said outer and inner diameters and having a radially outwardly facing ledge diametrically spaced from said pocket, and a handle that includes a C-shaped yoke having a first arm with an end hook for receipt in said pocket and a second arm with an end lug for snap-fit over said ledge;

wherein said ledge is not the same shape as said pocket and wherein said end hook is not the same shape as said end lug.

13. The assembly of claim 12 wherein said handle has opposite ends with one of said ends being a free end spaced from said body.

14. The assembly of claim 12 wherein said body has an axially opening recess and said handle has an end for receipt in said recess.

* * * * *